US008234810B2

(12) United States Patent
Lee, III

(10) Patent No.: US 8,234,810 B2
(45) Date of Patent: Aug. 7, 2012

(54) APPARATUS AND METHOD FOR LOADING BULLETS INTO A BULLET CARRIER OF A MAGAZINE

(75) Inventor: Kenneth Joe Lee, III, Cody, WY (US)

(73) Assignee: Lee Tactical Solutions, L.L.C., Cody, WY (US)

( * ) Notice: Subject to any disclaimer, the term of this patent is extended or adjusted under 35 U.S.C. 154(b) by 261 days.

(21) Appl. No.: 12/852,511

(22) Filed: Aug. 8, 2010

(65) Prior Publication Data

US 2012/0030987 A1 Feb. 9, 2012

(51) Int. Cl.
*F41A 9/82* (2006.01)
*F41A 9/83* (2006.01)

(52) U.S. Cl. ..... 42/87; 42/49.01; 42/50; 42/11; 42/6

(58) Field of Classification Search ..... 42/6, 11, 42/49.01, 49.02, 49.1, 50, 87, 88, 1.02; 89/195, 89/197
See application file for complete search history.

(56) References Cited

U.S. PATENT DOCUMENTS 1,245,499 A * 11/1917 Orme ..... 42/7
1,401,152 A * 12/1921 Green ..... 42/50
1,500,580 A * 7/1924 Fererro ..... 42/50
2,137,491 A * 11/1938 Huff ..... 42/90
2,296,729 A * 9/1942 Mossberg ..... 42/50
2,862,324 A 12/1958 Ball
2,885,811 A * 5/1959 Womble, Jr. ..... 42/50
2,910,795 A * 11/1959 Agren ..... 42/50
3,736,686 A * 6/1973 Moller et al. ..... 42/6
4,430,821 A * 2/1984 Vincent ..... 42/50
4,464,855 A 8/1984 Musgrave
4,488,371 A 12/1984 Boyles
4,688,344 A * 8/1987 Kim ..... 42/50
4,689,909 A 9/1987 Howard
4,719,715 A 1/1988 Howard
4,872,279 A 10/1989 Boat
4,993,180 A 2/1991 Upchurch
5,129,173 A 7/1992 Kuykendall
5,291,679 A * 3/1994 Wollack et al. ..... 42/50
5,309,660 A 5/1994 Blackamore
5,417,003 A 5/1995 Claveau
6,178,683 B1 1/2001 Williams
6,189,254 B1 2/2001 Steitz
6,219,953 B1 4/2001 Bentley
7,200,964 B2 4/2007 Gates
D548,552 S 8/2007 Elkaim
7,257,919 B1 8/2007 Farley
D564,316 S 3/2008 Elkaim (Continued)

*Primary Examiner* — Bret Hayes
*Assistant Examiner* — Joshua Freeman
(74) *Attorney, Agent, or Firm* — Antoinette M. Tease

(57) ABSTRACT

A device for loading cartridges into a magazine comprising: a magazine housing; a bullet carrier comprising a cartridge support seat and a spring; and a rod that is inserted into an aperture in the bottom end of the magazine housing and through the middle of the spring. In one embodiment, the cartridge support seat comprising a viewing port and a trough that extends from the underside of the cartridge support seat and is situated adjacent to the viewing port and beneath the feed lips of the magazine housing, and the L-shaped end of the rod is inserted through the middle of the spring and onto the shelf of the trough. In an alternate embodiment, the cartridge support seat comprises a viewing port and a second aperture, and the L-shaped end of the rod is inserted through the middle of the spring, through the viewing port, and into the second aperture.

9 Claims, 12 Drawing Sheets

U.S. PATENT DOCUMENTS

D604,792 S 11/2009 Stanley
2003/0226306 A1 12/2003 Hines
2011/0005115 A1* 1/2011 Cahill ..... 42/49.01
2011/0302816 A1* 12/2011 Fitzpatrick et al. ..... 42/50

* cited by examiner

APPARATUS AND METHOD FOR LOADING BULLETS INTO A BULLET CARRIER OF A MAGAZINE

BACKGROUND OF THE INVENTION

1. Field of the Invention

The present invention relates generally to the field of firearms, and more specifically, to an apparatus and method for loading bullets into a bullet carrier of a magazine.

2. Description of the Related Art

A number of inventions have been directed toward solving the problem of making it easier to load bullets into the bullet carrier inside of the magazine cartridge of a firearm. The bullet carrier comprises a spring, and the spring becomes more compressed as more bullets are loaded; thus, it become increasingly harder to insert the next bullet. To solve this problem, various mechanisms have been designed to assist in the compression of the spring of the bullet carrier.

For example, U.S. Pat. No. 2,862,324 (Ball, 1958) provides a clip-side depressor to facilitate the reloading of reloadable cartridge clips that serve as magazines for automatic pistols. The clip-side depressor is slipped over the open end of a cartridge clip with the upper end of the slot of the depressor engaging a pin or button of the slide within the clip. The clip-slide depressor is then pulled longitudinally against the pressure of the spring mounted within the clip body. In this invention, the depressor button or pin projects from one side of the clip body portion through a longitudinal slot formed in the side of the clip body portion; thus, this invention is not entirely internal to the cartridge.

In U.S. Pat. No. 4,464,855 (Musgrave, 1984), a device enters the feed mouth of a magazine and depresses the top-most cartridge inside of the magazine. The device also serves as a loading tray to guide the next incoming cartridge into the feed mouth. The device comprises a base with sides and a tray on one end and a handle on the other end. A latch is flexibly mounted to the base by means of a curved spring. This invention differs from the present invention in that it is inserted into the feed mouth of the magazine and does not involve compressing the spring from the base end (or floor) of the magazine. The '855 patent provides a good explanation of the difficulties encountered in loading the magazine of an automatic pistol.

U.S. Pat. No. 4,488,371 (Boyles, 1984) discloses a latch for relieving spring tension or pressure from a follower that slides up and down inside a cavity of a magazine. The latch includes a button that projects outwardly from the side of the follower through a slot in the magazine. The button is depressed (thereby compressing the spring) by a separate "hold down device" that includes a small slot for engaging the button. This invention also differs from the present invention in that it involves an outward projection from the inside of the magazine.

U.S. Pat. Nos. 4,689,909 (Howard, 1987) and 4,719,715 (Howard, 1988) provide a magazine charger that incorporates a plunger that enters the open (or feed) end of the magazine and is used to move cartridges against the magazine spring. The plunger comprises a plunger spring that causes the plunger to resume its initial position after the magazine is filled with cartridges and the user lifts his finger pressure from the top of the plunger. This invention is different than the present invention because it involves inserting something from the feed end of the magazine rather than the base end.

U.S. Pat. No. 4,872,279 (Boat, 1989) discloses a reloading device in which the magazine housing comprises an elongate slot through which a retracting button projects. The retracting button is engaged with the follower inside of the magazine. A projection extends from the elongate rigid member of the reloading device, and this projection functions as a hand grip means for manual manipulation of the reloading device. A recess on the bottom end of the elongate rigid member is placed around the retracting button, and downward force is placed on the projection. In this manner, the follower is moved downward within the magazine housing, and the magazine spring is compressed. As with the '324 and '371 patents discussed above, the '279 patent involves a button or pin that extends outwardly from the magazine housing and that may easily break or become damaged with use.

U.S. Pat. No. 4,993,180 (Upchurch, 1991) describes a rectangular sleeve with an interior plunging member and an exterior serrated gripping surface. The rectangular sleeve is placed around the feed (open) end of the magazine. A short rigid protrusion extending downward from the inner surface of the ceiling of the rectangular sleeve pushes on the top-most cartridge, thereby creating space for the next cartridge to be inserted. As with the '919 and '715 patents discussed above, this invention involves pushing downward on one of the cartridges in the feed end of the magazine to create room for the next cartridge to be inserted.

U.S. Pat. No. 5,129,173 (Kuykendall, 1992) entails a pin that is removably inserted into a retention hole in the side of the magazine and is used to compress the magazine spring from the top downward. The pin is operated by means of two outwardly extending flanges that are pinched together by the user. One of the flanges moves slidably relative to a retention hole in the slide (or magazine housing) and is fixedly connected to the pin. U.S. Pat. No. 5,309,660 (Blackamore, 1994) utilizes a key that is inserted through a longitudinal slot in the side panel of the magazine and secured with notches spaced evenly along the slot to compress the magazine spring. Both the '173 and '660 patents involve similar mechanisms in that they use pins or keys inserted through the side of the magazine to hold the magazine spring down.

U.S. Pat. No. 5,417,003 (Claveau, 1995) involves a device that is intended to facilitate the loading of bullets into a magazine. The device is a separate piece, one facet of which is a recess that engages with a pin that extends outwardly from the magazine housing and is connected to the follower (or bullet carrier). U.S. Pat. No. 6,178,683 (Williams, 2001) describes a magazine reloader with an L-shaped grip. The magazine is held against the interior of the grip, and a plunger is manually pressed against the follower or against the top-most cartridge in the follower to allow a cartridge to be inserted. These two patents are similar in operation to the other inventions discussed above in that the '003 invention operates via a pin extending outwardly through the magazine housing, and the '683 invention involves a plunger.

U.S. Pat. No. 6,189,254 (Steitz, 2001) provides a band that fits around a user's thumb and from which extends a projection that is used to push downward on the top-most cartridge in the bullet carrier, thereby creating space for the next cartridge to be inserted. U.S. Pat. No. 6,219,953 (Bentley, 2001) involves an apparatus very similar to that described in the '254 patent. The latter invention comprises a digit securing means and a protrusion that allows the user to exert downward force on the top-most cartridge in the bullet carrier.

U.S. Pat. No. 7,257,919 (Farley, 2007) provides yet another vertically extending plunger that exerts force on the top-most cartridge in the bullet carrier, thereby creating space to load the next cartridge. This particular loader is maintained in sliding contact with the magazine by virtue of a magnet mounted on the rear of the loader. U.S. Pat. No. 7,200,964 (Gates, 2007) discloses a firearm cartridge clip in which the compression spring is pulled downward (compressed) via a cable attached to the underside of the follower (a/k/a elevator) element. Two side leaf springs prevent the cartridge support seat from moving downward with the elevator element when the cable is pulled. As cartridges are loaded manually onto the cartridge support seat, the only force that has to be overcome by the user is the force of the side leaf springs because the compression spring has been fully compressed by the cable.

U.S. Patent Application Pub. No. 2003/0226306 (Hines) describes a magazine loading and unloading tool that is an ellipsoid planar body measuring about 1.5 inches long and 1/25 inches wide. A slot in the tool is sized to encompass a button extending from a follow in a magazine, as described in connection with several of the inventions discussed above.

BRIEF SUMMARY OF THE INVENTION

The present invention is a device for loading cartridges into a magazine comprising: a magazine housing comprising a bottom end with an aperture and a top end with feed lips; a bullet carrier comprising a cartridge support seat and a spring; the cartridge support seat comprising an underside, a viewing port and a trough, wherein the trough extends from the underside of the cartridge support seat and is situated adjacent to the viewing port and beneath the feed lips of the magazine housing, and wherein the trough comprises a shelf; the spring having a middle, wherein the spring is situated between the cartridge support seat and the bottom end of the magazine housing, and wherein the spring pushes the cartridge support seat up against the feed lips of the top end of the magazine housing when the spring is not being manually compressed and when there are no cartridges on the cartridge support seat; and a rod that is inserted into the aperture in the bottom end of the magazine housing and through the middle of the spring, wherein the rod comprises an L-shaped end, and wherein the L-shaped end of the rod is placed onto the shelf of the trough; wherein when downward pressure is placed on the rod against the shelf, the cartridge support seat moves further away from the feed lips of the magazine housing and toward the bottom end of the magazine housing, thereby creating a space between the feed lips and the cartridge support seat for the insertion of a cartridge.

In a preferred embodiment, the rod comprises an end opposite the L-shaped end, and wherein the end opposite the L-shaped end comprises a ring. Preferably, the rod comprises an end opposite the L-shaped end, and wherein the end opposite the L-shaped end comprises a hook. The L-shaped end of the rod preferably comprises a knob that prevents the rod from moving laterally on the shelf of the trough when the L-shaped end of the rod is placed onto the shelf of the trough and downward pressure is placed on the rod against the shelf.

In a preferred embodiment, the viewing port on the cartridge support carrier is vertically aligned with the aperture in the bottom end of the magazine housing. Preferably, the rod comprises a marker that indicates to a user when the spring has been compressed far enough to fully load the bullet carrier.

In an alternate embodiment, the present invention is a device for loading cartridges into a magazine comprising: a magazine housing comprising a bottom end with a first aperture and a top end with feed lips; a bullet carrier comprising a cartridge support seat and a spring; the cartridge support seat comprising an underside, a viewing port and a second aperture; the spring having a middle, wherein the spring is situated between the cartridge support seat and the bottom end of the magazine housing, and wherein the spring pushes the cartridge support seat up against the feed lips of the top end of the magazine housing when the spring is not being manually compressed and when there are no cartridges on the cartridge support seat; and a rod that is inserted into the aperture in the bottom end of the magazine housing and through the middle of the spring, wherein the rod comprises an L-shaped end with a knob, and wherein the L-shaped end of the rod is inserted through the viewing port, and the knob is inserted into the second aperture; wherein when downward pressure is placed on the rod against the cartridge support seat, the cartridge support seat moves further away from the feed lips of the magazine housing and toward the bottom end of the magazine housing, thereby creating a space between the feed lips and the cartridge support seat for the insertion of a cartridge.

The present invention also includes a method of loading bullets into a bullet carrier of a magazine comprising: providing a magazine housing comprising a top end with feed lips and a bottom end with an aperture; providing a bullet carrier comprising a cartridge support seat with a trough extending downward underneath the cartridge support seat and further comprising a spring with a middle; inserting a rod with an L-shaped end through the aperture in the bottom end of the magazine housing and through the middle of the spring; placing the L-shaped end of the rod on a shelf formed by the trough; and pulling downward on the rod, thereby moving the cartridge support seat away from the feed lips on the top end of the magazine housing and creating a space for insertion of a cartridge.

In an alternate embodiment, the present invention is a method of loading bullets into a bullet carrier of a magazine comprising: providing a magazine housing comprising a top end with feed lips and a bottom end with a first aperture; providing a bullet carrier comprising a cartridge support seat with a viewing port and a second aperture and further comprising a spring with a middle; inserting a rod with an L-shaped end and a knob on the L-shaped end through the aperture in the bottom end of the magazine housing and through the middle of the spring; placing the L-shaped end of the rod through the viewing port on the cartridge support seat such that the knob on the L-shaped end extends through the second aperture; and pulling downward on the rod, thereby moving the cartridge support seat away from the feed lips on the top end of the magazine housing and creating a space for insertion of a cartridge.

REFERENCE NUMBERS

1 Magazine housing
2 Bottom end (of magazine housing)
3 Cartridge support seat
3*a* Ceiling (of cartridge support seat)
3*b* Extension (from ceiling of cartridge support seat)
4 Magazine (or compression) spring
5 Rod
6 Ring
7 L-shaped end (of rod)
8 Knob (on end of L-shaped end of rod)
9 Twist/marker (on rod)
10 Feed lips
11 Trough
11*a* Longitudinal face (of trough)
11*b* Lateral face (of trough)
12 Aperture (in bottom end of magazine housing)
13 Cartridge
14 Carabiner
15 Viewing port (in cartridge support seat)
16 Aperture (on cartridge support seat for insertion of knob)

DETAILED DESCRIPTION OF INVENTION

Figure 1:
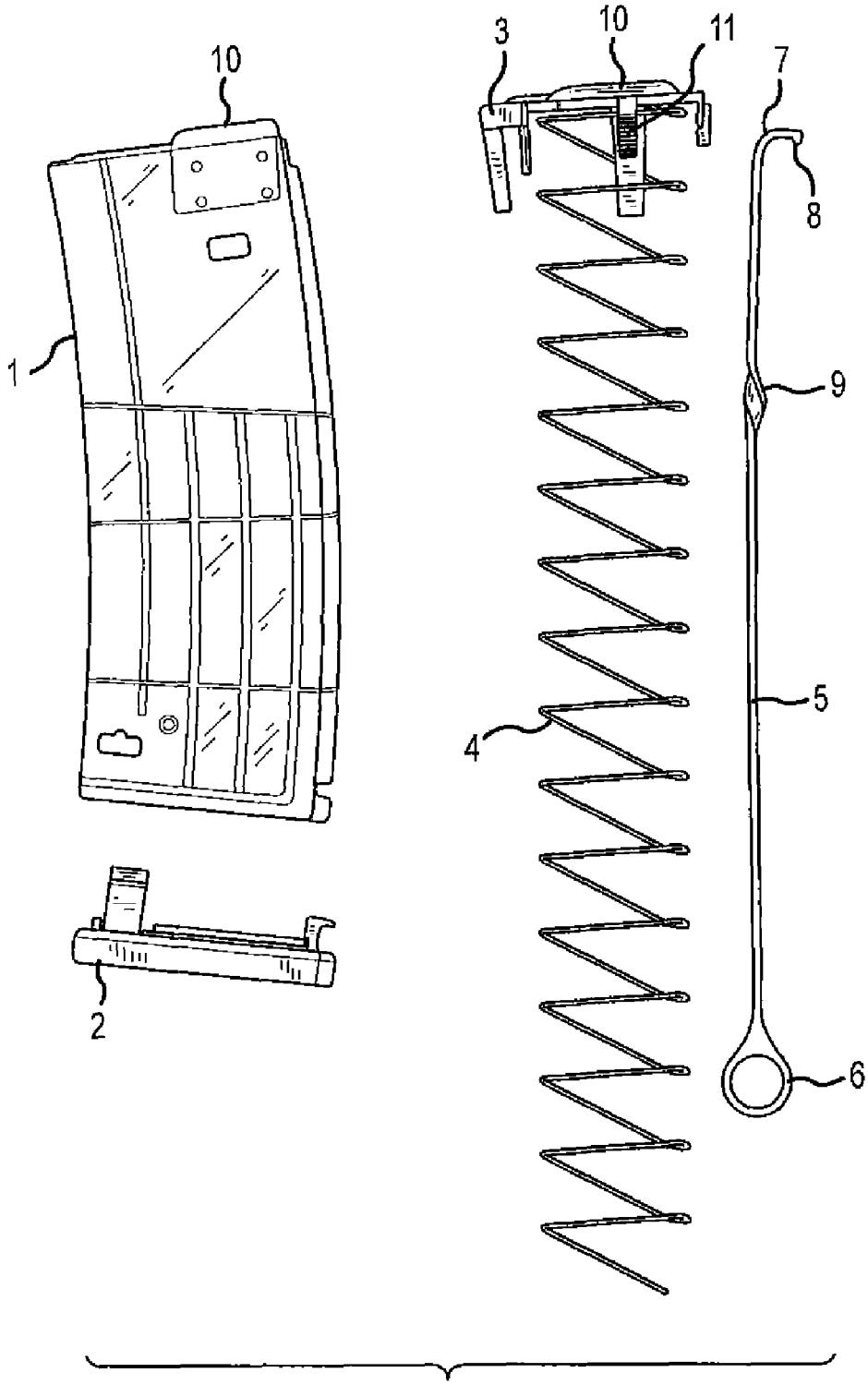
FIG. 1 is a side view of a first embodiment of the present invention shown with one type of magazine.

FIG. 1 is a side view of a first embodiment of the present invention shown with one type of magazine. This figure shows a magazine housing 1, bottom end 2 of the magazine housing 1, cartridge support seat 3 and magazine (or compression) spring 4 from an AR15 automatic rifle. The cartridge support seat 3 and magazine spring 4 are also referred to herein as the "bullet carrier." Although the AR15 magazine housing and bullet carrier are shown in FIGS. 1-7, the present invention applies to any magazine of an automatically loading firearm with a spring-loaded bullet carrier.

As shown in FIG. 1, the present invention comprises a rod 5. The rod 5 preferably comprises a ring 6 or hook (not shown) on one end; the other end of the rod 5 is preferably L-shaped. The L-shaped end 7 of the rod preferably comprises a knob 8, the purpose of which will become clear in subsequent figures. In addition, the rod 5 preferably comprises a twist 9 or other marker in roughly the location shown in FIG. 1. The function of the twist 9 in the rod is discussed in connection with FIG. 3.

Figure 5:
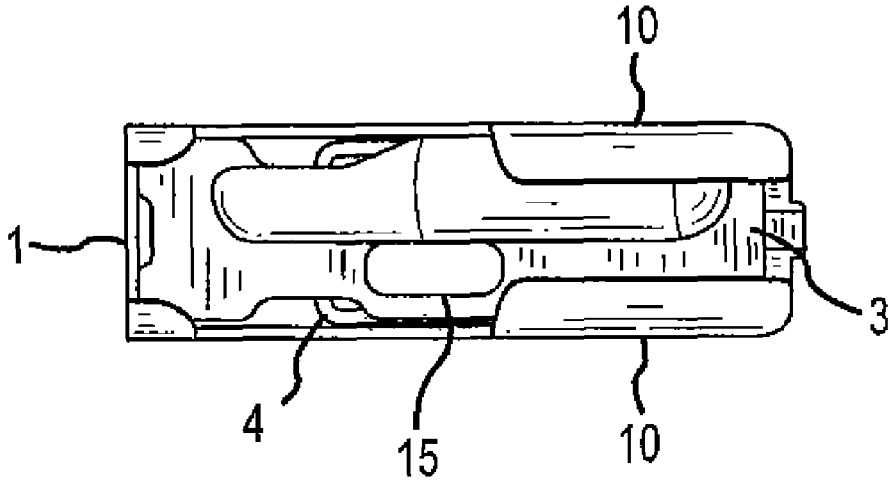
FIG. 5 is a top view of the feed end of the magazine shown in FIG. 1.

As shown in this figure, one end of the magazine spring 4 is situated directly beneath the cartridge support seat 3. The other end of the magazine spring 4 abuts up against the bottom end 2 of the magazine housing 1 such that when the spring is placed inside of the magazine housing 1, tension in the spring 4 causes the cartridge support seat 3 to press up against the feed lips 10 on either side of the top (feed mouth) of the magazine housing 1. The position of the feed lips 10 is also shown in FIG. 5.

In the present invention, the cartridge support seat 3 has been modified to provide a trough 11 extending downward from the underside of the cartridge support seat 3. The purpose of the trough 11 is discussed in connection with FIG. 2. In this particular embodiment, the trough 11 is L-shaped and is comprised of a longitudinal face 11*a* and a lateral face 11*b* (see FIG. 6). The distal end of the longitudinal face 11*a* is fixedly attached to the ceiling of 3*a* of the cartridge support seat 3, and the distal end of the lateral face 11*b* is fixedly attached to an extension 3*b* that protrudes downward from the ceiling 3*a* of the cartridge support seat 3. The proximal ends of the longitudinal face 11*a* and the lateral face 11*b* join together to form the bend in the L-shaped trough 11.

Figure 2:
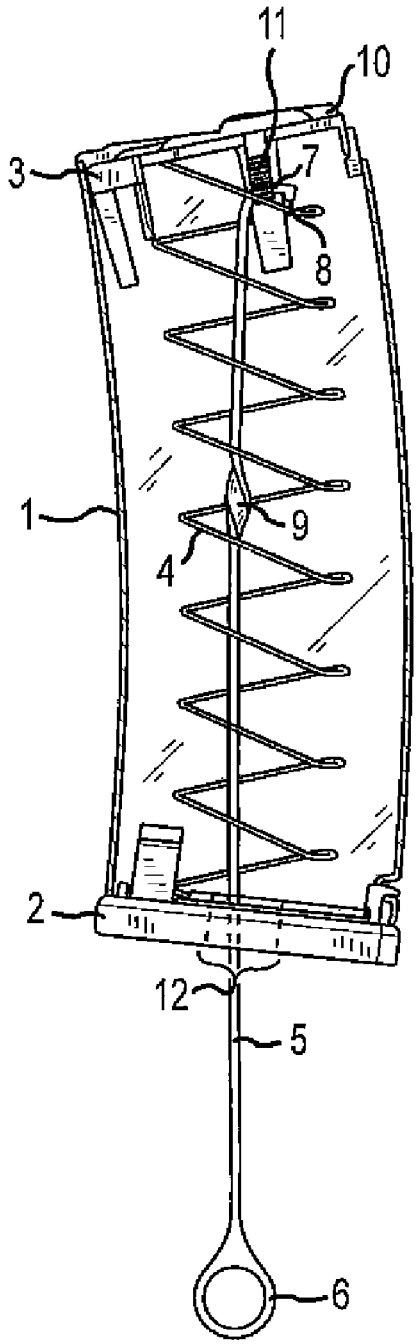
FIG. 2 is a side section view of the embodiment shown in FIG. 1 with the bullet carrier inserted into the magazine and the rod inserted into the bullet carrier.

FIG. 2 is a side section view of the embodiment shown in FIG. 1 with the bullet carrier inserted into the magazine and the rod inserted into the bullet carrier. As shown in this figure, the rod 5 is inserted into the bottom end 2 of the magazine housing 1 through an aperture 12 (see FIG. 4) in the bottom end 2. The rod 5 is then extended all of the way through the inside of the spring 4 and up to the trough 11, where the L-shaped end 7 of the rod 5 is inserted through the trough 11. Preferably, the knob 8 on the end of the L-shaped end 7 of the rod 5 assists in maintaining the L-shaped end 7 in place, as shown in FIG. 2.

Once the rod 5 is positioned as shown in FIG. 2, then the user exerts downward pressure (i.e., in the direction of the ring 6) on the rod 5, thereby pulling the cartridge support seat 3 toward the bottom end 2 of the magazine housing 1.

Figure 3:
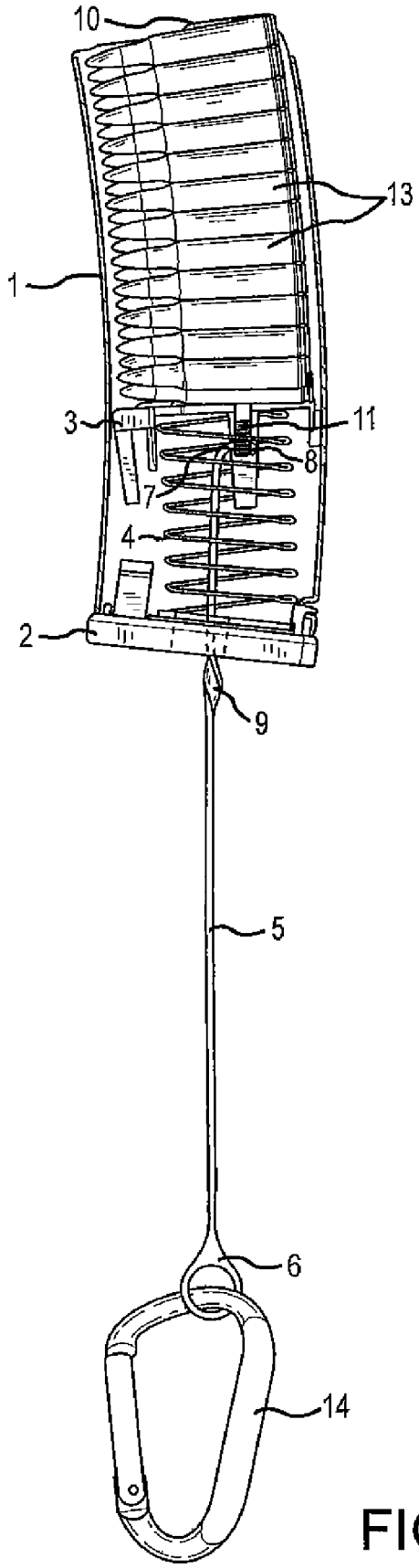
FIG. 3 is a side view of the embodiment shown in FIG. 2 with the compression spring compressed by the rod.

FIG. 3 is a side view of the embodiment shown in FIG. 2 with the compression spring compressed by the rod. In this figure, the cartridge support seat 3 has been pulled downward toward the bottom end 2 of the magazine housing 1 by the rod 5 in the trough 11. The twist 9 or marker (not shown) tells the user when the spring 4 has been compressed enough to fully load the bullet carrier. As the cartridge support seat 3 is pulled downward toward the bottom end 2 of the housing 1, cartridges 13 (or bullets) are inserted through the feed mouth 14 of the magazine housing 1 (see FIG. 5). The first cartridge 13 is placed directly on top of the cartridge support seat 3, and subsequent cartridges 13 are placed on top of the already loaded cartridges. When the bullet carrier is fully loaded, the user simply removes the rod from the bullet carrier by pulling it back out through the middle of the spring 4.

As shown in FIG. 3, one method of compressing the spring 4 (and pulling the cartridge support seat 3 toward the bottom end 2 of the magazine housing 1) is to attach the ring 6 to a carabiner 14 and then to attach the carabiner 14 to the user's belt loop (not shown). In this manner, the spring 4 is compressed simply by pulling the magazine housing 1 away from the user. Thus, the magazine housing 1 may be held with one hand and the cartridges 13 inserted with the other hand.

Figure 4:
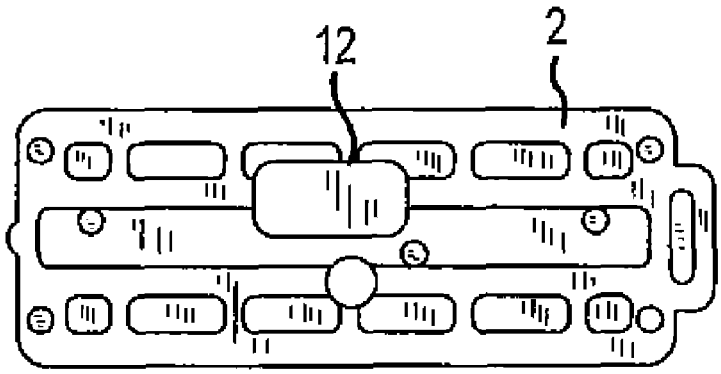
FIG. 4 is a bottom view of the base end of the magazine shown in FIG. 1.

FIG. 4 is a bottom view of the base end of the magazine shown in FIG. 1. This figure shows the aperture 12 through which the rod 5 is inserted.

FIG. 5 is a top view of the feed end of the magazine shown in FIG. 1. As shown in this figure, the cartridge support seat 3 preferably comprises a viewing port 15 through which the viewer may view the insertion of the rod 5 through the aperture 12 in the bottom end 2 of the magazine housing 1 and up through the middle of the spring 4. The viewing port 15 is preferably vertically aligned with the aperture 12 in the bottom end 2. The trough 11 is preferably located adjacent to the viewing port 3 and directly underneath the feed lips 10 on the top end (or feed mouth) of the magazine housing 1.

Figure 6:
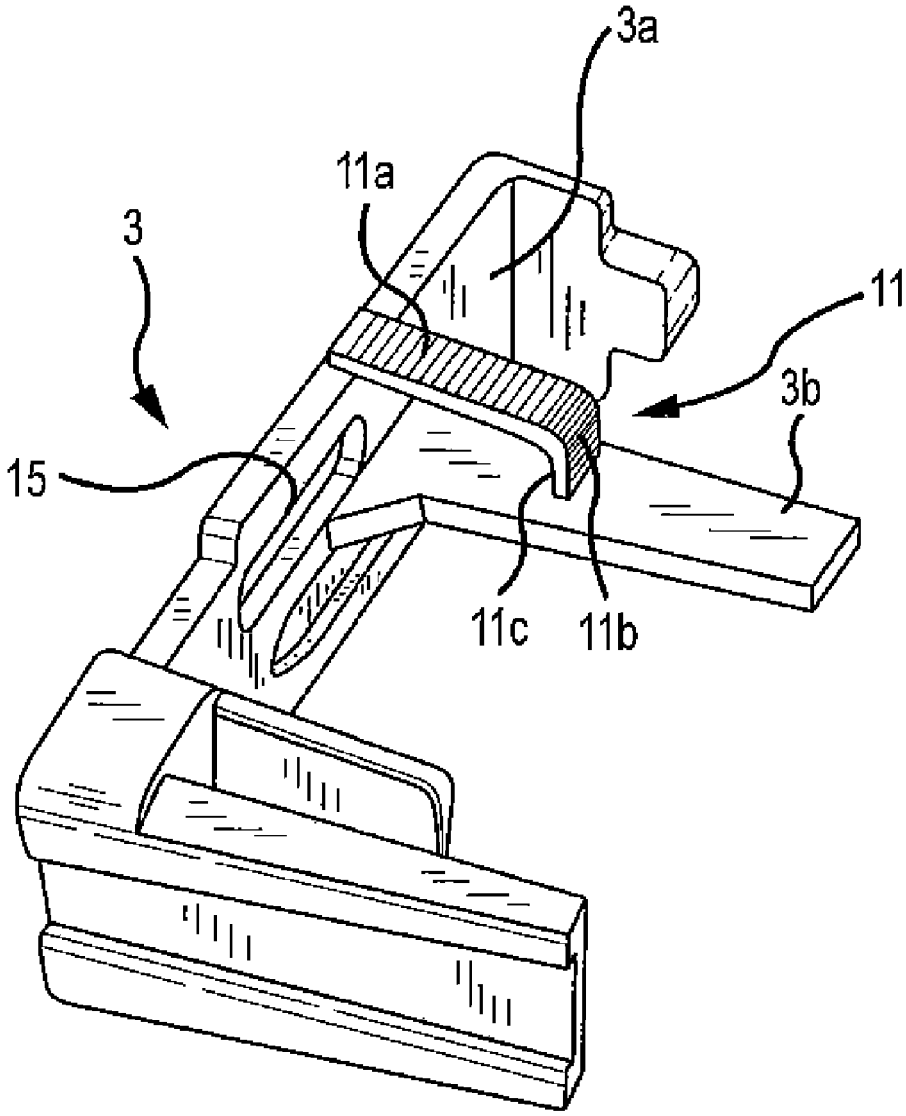
FIG. 6 is a detail perspective view of the cartridge support seat of the embodiment shown in FIG. 1.

FIG. 6 is a detail perspective view of the cartridge support seat of the embodiment shown in FIG. 1. The trough 11 shown in FIG. 6 is but one example of how a trough 11 might be configured. The present invention is not limited to any particular configuration of the trough 11 as long as it is located adjacent to the viewing port, underneath the feed lips 10 (see FIG. 1) of the magazine housing 1, and forms a shelf 11*c* onto which the L-shaped end 7 of the rod 5 may be placed in order to put downward pressure on the cartridge support seat 3.

Figure 7:
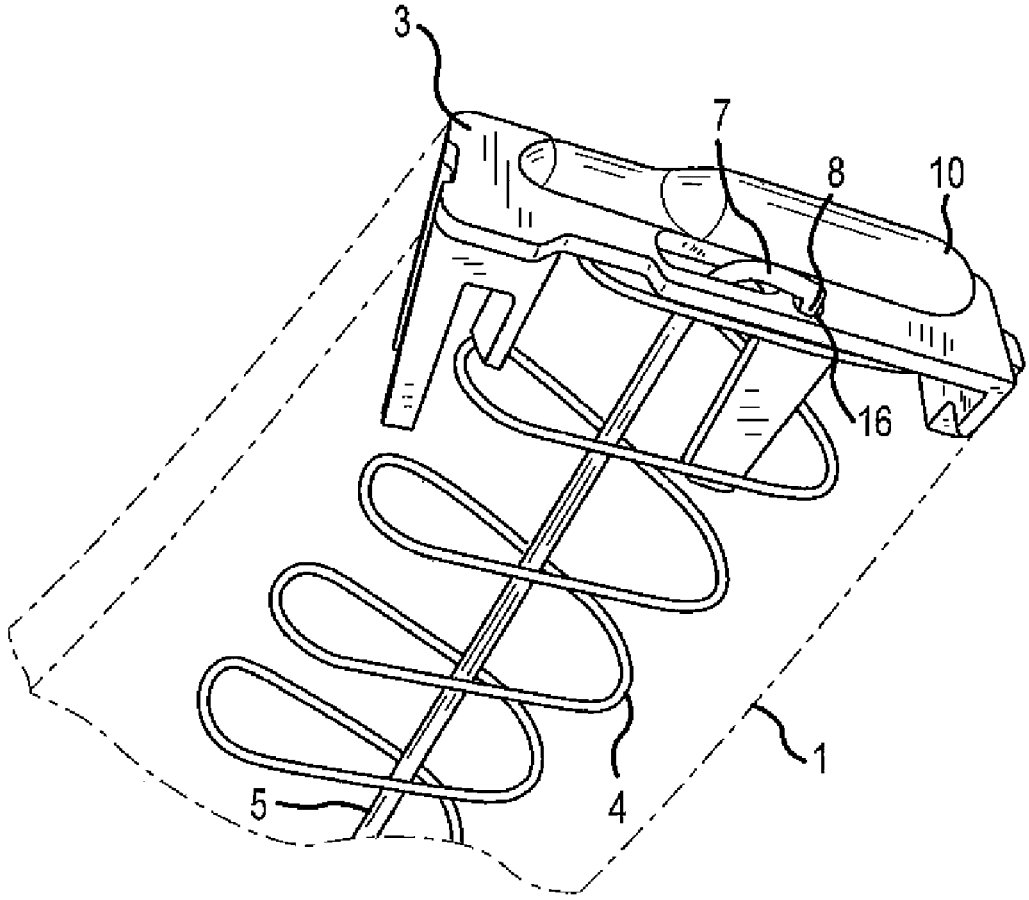
FIG. 7 is a detail perspective view of an alternate embodiment of the cartridge support seat shown in FIG. 6.

FIG. 7 is a detail perspective view of an alternate embodiment of the cartridge support seat shown in FIG. 6. In this embodiment, there is no trough 11, and the L-shaped end of the rod 5 is inserted through the aperture 12 in the bottom end 2 of the magazine housing 1, up through the middle of the spring 4, and out through the viewing port 15 in the cartridge support seat 3. The knob 8 on the end of the L-shaped end 7 of the rod is then inserted into a smaller aperture 16 in the cartridge support seat 3. This smaller aperture 16 is preferably situated further toward the "brass end" of the cartridge support seat 3 than the viewing port 15 so as to ensure that the rod is inserted in the correction direction (i.e., with pressure being exerted on the brass end of the cartridge support seat 3). The "brass end" of the cartridge support seat is designated with an "X" in FIG. 7. In this manner, the rod 5 may then be pulled downward to compress the spring 4 and allow for the insertion of cartridges 13.

Figure 8:
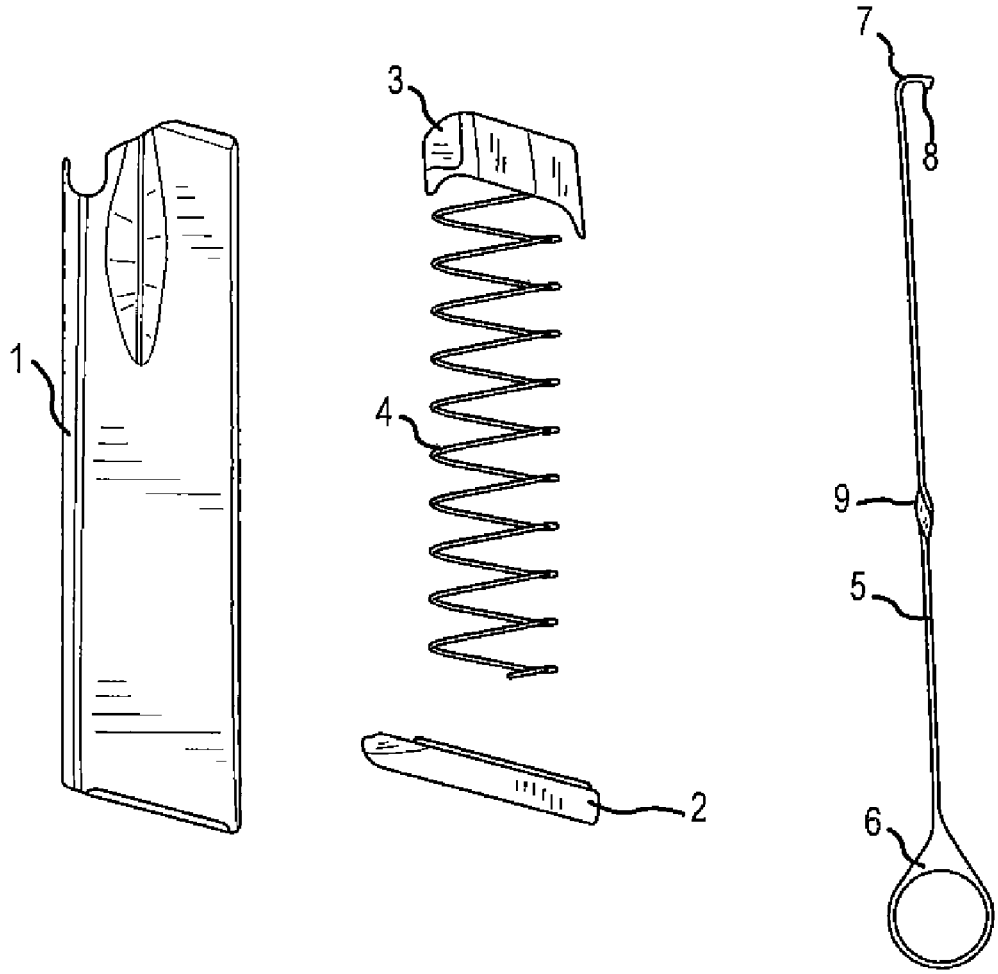
FIG. 8 is a side view of a first embodiment of the present invention shown with a different type of magazine than in FIG. 1.

FIG. 8 is a side view of a first embodiment of the present invention shown with a different type of magazine than in FIG. 1. FIGS. 8-14 are similar to FIGS. 1-7 except that a different type of magazine is shown. In these figures, the magazine is from a Smith & Wesson .40-caliber automatic pistol. The structure and operation of the present invention are otherwise the same as described above in connection with FIGS. 1-7 except that the trough 11 is configured slightly differently to accommodate a different type of cartridge support seat 3. In FIG. 8, the magazine housing 1, bottom end 2 of the magazine housing 1, cartridge support seat 3, spring 4 and rod 5 are shown.

Figure 9:
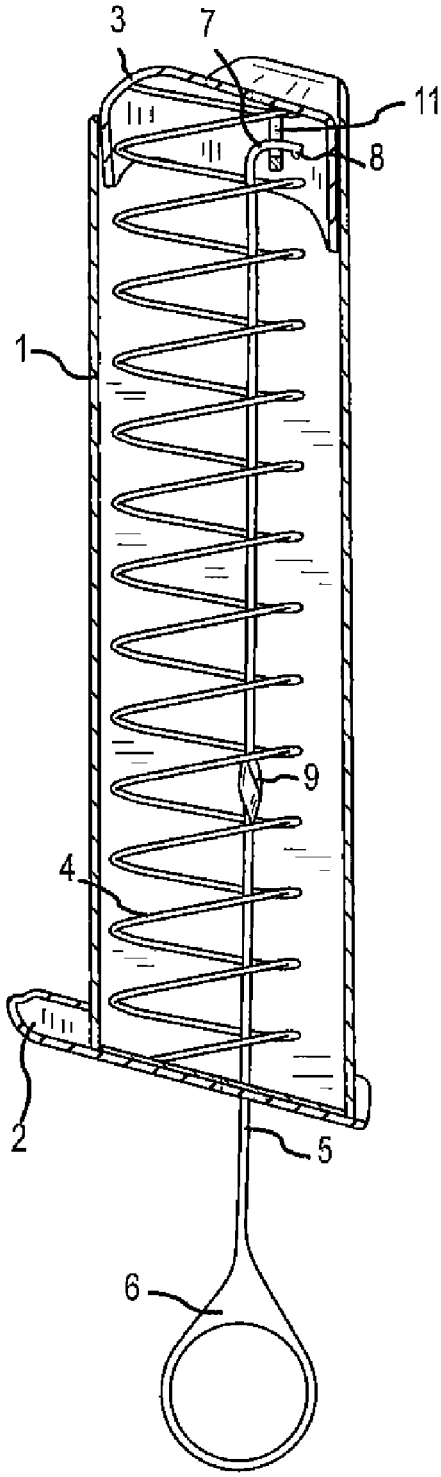
FIG. 9 is a side section view of the embodiment shown in FIG. 8 with the bullet carrier inserted into the magazine and the rod inserted into the bullet carrier.

FIG. 9 is a side section view of the embodiment shown in FIG. 8 with the bullet carrier inserted into the magazine and the rod inserted into the bullet carrier. In FIG. 9, the rod 5 has been inserted through the aperture 12 in the bottom end 2 of the magazine housing 1 (see FIG. 11), up through the middle of the spring 4, and through the trough 11 underneath the cartridge support seat 3.

Figure 10:
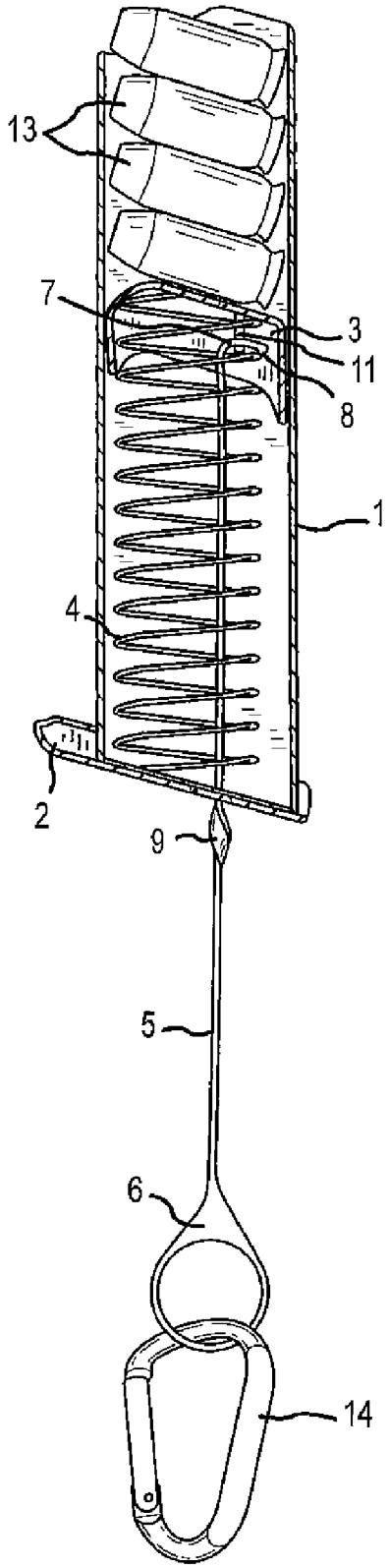
FIG. 10 is side view of the embodiment shown in FIG. 9 with the compression spring compressed by the rod.

FIG. 10 is side view of the embodiment shown in FIG. 9 with the compression spring compressed by the rod. In FIG. 10, the spring 4 has been compressed by the rod 5, and four cartridges 13 have been inserted on top of the cartridge support seat 3.

Figure 11:
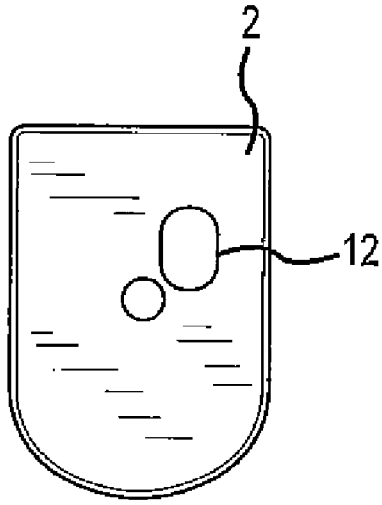
FIG. 11 is a bottom view of the base end of the magazine shown in FIG. 8.
Figure 12:
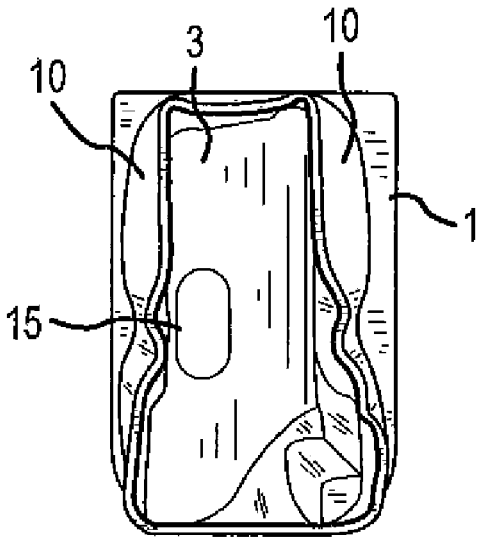
FIG. 12 is a top view of the feed end of the magazine shown in FIG. 8.

FIG. 11 is a bottom view of the base end of the magazine shown in FIG. 8. This figure shows the aperture 12 through which the rod 5 is inserted. FIG. 12 is a top view of the feed end of the magazine shown in FIG. 8. This figure shows the viewing port 15 in the cartridge support seat 3. It also shows the feed lips 10 on top of the magazine housing 1. The feed lips 10 prevent the cartridge support seat 3 from extending above the top of the magazine housing 1.

Figure 13:
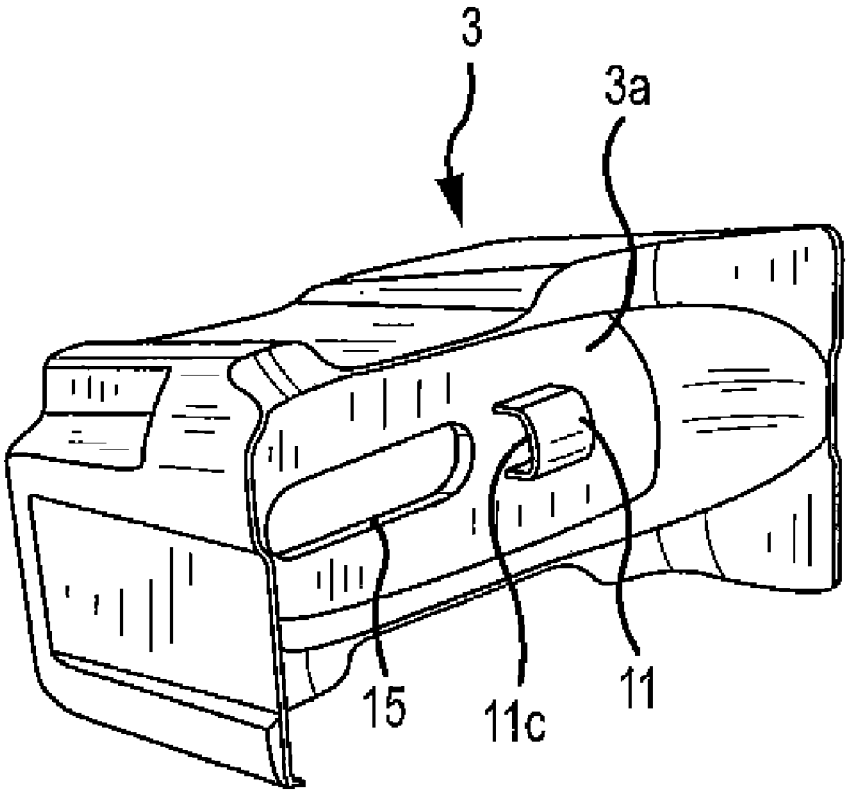
FIG. 13 is a detail perspective view of the cartridge support seat of the embodiment shown in FIG. 8.

FIG. 13 is a detail perspective view of the cartridge support seat of the embodiment shown in FIG. 8. In this embodiment, the trough 11 is U-shaped, with both'ends of the "U" fixedly attached to the ceiling 3*a* of the cartridge support seat 3. By virtue of its "U" shape, the trough 11 creates a shelf 11*c* on which the L-shaped end 7 of the rod 5 may rest to pull the cartridge support seat 3 down (i.e., away from the top of the magazine housing 1). This figure also shows the viewing port 15 in the cartridge support seat 3.

Figure 14:
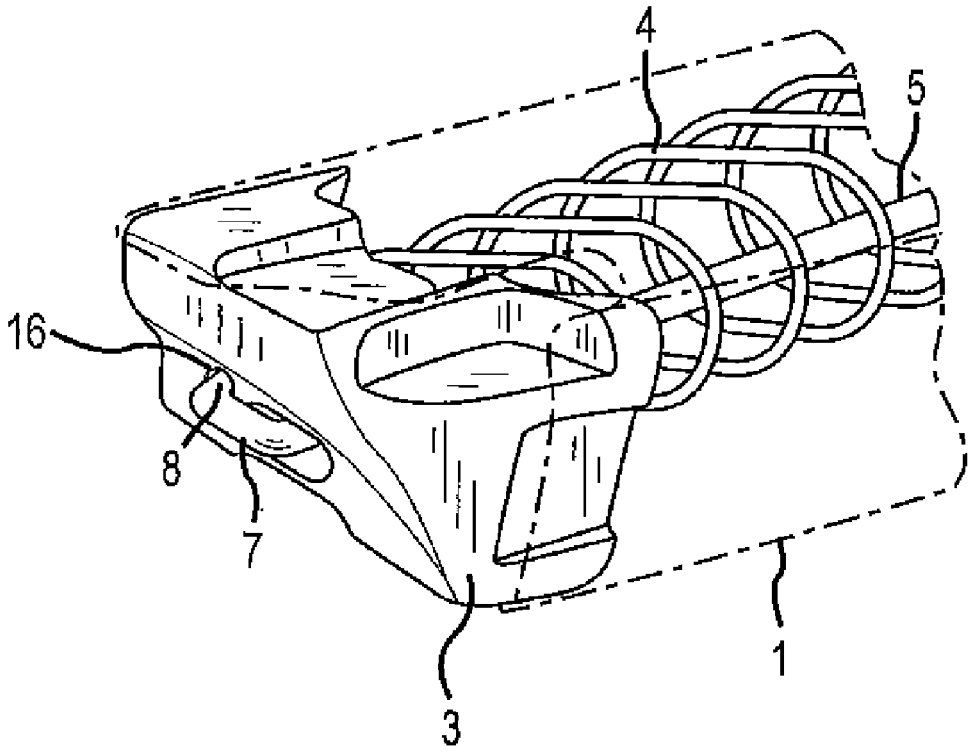
FIG. 14 is a detail perspective view of an alternate embodiment of the cartridge support seat shown in FIG. 13.

FIG. 14 is a detail perspective view of an alternate embodiment of the cartridge support seat shown in FIG. 13. In this embodiment, as in the embodiment shown in FIG. 7, there is no trough 11, and the L-shaped end of the rod 5 is inserted through the aperture 12 in the bottom end 2 of the magazine housing 1, up through the middle of the spring 4, and out through the viewing port 15 in the cartridge support seat 3. The knob 8 on the end of the L-shaped end 7 of the rod is then inserted into a smaller aperture 16 in the cartridge support seat 3. This smaller aperture 16 is preferably situated further toward the "brass end" of the cartridge support seat 3 (described above) than the viewing port 15 to ensure proper orientation of the rod 5.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A device for loading cartridges into a magazine comprising:

a magazine housing comprising a bottom end with an aperture and a top end with feed lips;

a bullet carrier comprising a cartridge support seat and a spring;

the cartridge support seat comprising an underside, a viewing port and a trough, wherein the trough extends from the underside of the cartridge support seat and is situated adjacent to the viewing port and beneath the feed lips of the magazine housing, and wherein the trough comprises a shelf;

the spring having a middle, wherein the spring is situated between the cartridge support seat and the bottom end of the magazine housing, and wherein the spring pushes the cartridge support seat up against the feed lips of the top end of the magazine housing when the spring is not being manually compressed and when there are no cartridges on the cartridge support seat; and a rod that is inserted into the aperture in the bottom end of the magazine housing and through the middle of the spring, wherein the rod comprises an L-shaped end, and wherein the L-shaped end of the rod is placed onto the shelf of the trough;

wherein when downward pressure is placed on the rod against the shelf, the cartridge support seat moves further away from the feed lips of the magazine housing and toward the bottom end of the magazine housing, thereby creating a space between the feed lips and the cartridge support seat for the insertion of a cartridge.

2. The device of claim 1, wherein the rod comprises an end opposite the L-shaped end, and wherein the end opposite the L-shaped end comprises a ring.

3. The device of claim 1, wherein the rod comprises an end opposite the L-shaped end, and wherein the end opposite the L-shaped end comprises a hook.

4. The device of claim 1, wherein the L-shaped end of the rod comprises a knob that prevents the rod from moving laterally on the shelf of the trough when the L-shaped end of the rod is placed onto the shelf of the trough and downward pressure is placed on the rod against the shelf.

5. The device of claim 1, wherein the viewing port on the cartridge support carrier is vertically aligned with the aperture in the bottom end of the magazine housing.

6. The device of claim 1, wherein the rod comprises a marker that indicates to a user when the spring has been compressed far enough to fully load the bullet carrier.

7. A device for loading cartridges into a magazine comprising:

a magazine housing comprising a bottom end with a first aperture and a top end with feed lips;

a bullet carrier comprising a cartridge support seat and a spring;

the cartridge support seat comprising an underside, a viewing port and a second aperture;

the spring having a middle, wherein the spring is situated between the cartridge support seat and the bottom end of the magazine housing, and wherein the spring pushes the cartridge support seat up against the feed lips of the top end of the magazine housing when the spring is not being manually compressed and when there are no cartridges on the cartridge support seat; and a rod that is inserted into the aperture in the bottom end of the magazine housing and through the middle of the spring, wherein the rod comprises an L-shaped end with a knob, and wherein the L-shaped end of the rod is inserted through the viewing port, and the knob is inserted into the second aperture;

wherein when downward pressure is placed on the rod against the cartridge support seat, the cartridge support seat moves further away from the feed lips of the magazine housing and toward the bottom end of the magazine housing, thereby creating a space between the feed lips and the cartridge support seat for the insertion of a cartridge.

8. A method of loading bullets into a bullet carrier of a magazine comprising:

providing a magazine housing comprising a top end with feed lips and a bottom end with an aperture;

providing a bullet carrier comprising a cartridge support seat with a trough extending downward underneath the cartridge support seat and further comprising a spring with a middle;

inserting a rod with an L-shaped end through the aperture in the bottom end of the magazine housing and through the middle of the spring;

placing the L-shaped end of the rod on a shelf formed by the trough; and pulling downward on the rod, thereby moving the cartridge support seat away from the feed lips on the top end of the magazine housing and creating a space for insertion of a cartridge.

9. A method of loading bullets into a bullet carrier of a magazine comprising:

providing a magazine housing comprising a top end with feed lips and a bottom end with a first aperture;

providing a bullet carrier comprising a cartridge support seat with a viewing port and a second aperture and further comprising a spring with a middle;

inserting a rod with an L-shaped end and a knob on the L-shaped end through the aperture in the bottom end of the magazine housing and through the middle of the spring;

placing the L-shaped end of the rod through the viewing port on the cartridge support seat such that the knob on the L-shaped end extends through the second aperture; and pulling downward on the rod, thereby moving the cartridge support seat away from the feed lips on the top end of the magazine housing and creating a space for insertion of a cartridge.

* * * * *